US012421833B2

(12) United States Patent
Malki et al.

(10) Patent No.: US 12,421,833 B2
(45) Date of Patent: Sep. 23, 2025

(54) HOLLOW ELECTRICAL SUBMERSIBLE PUMP FOR UNLIMITED WELLBORE INTERVENTION

(71) Applicant: SAUDI ARABIAN OIL COMPANY, Dhahran (SA)

(72) Inventors: Bandar S. Malki, Dhahran (SA); Juan Manuel Polo Terán, Dhahran (SA); Basil Ali Abdullah Alghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 290 days.

(21) Appl. No.: 18/298,240

(22) Filed: Apr. 10, 2023

(65) Prior Publication Data

US 2024/0337176 A1 Oct. 10, 2024

(51) Int. Cl.

| | |
|---|---|
| ***E21B 43/12*** | (2006.01) |
| ***E21B 23/14*** | (2006.01) |
| ***F04B 47/06*** | (2006.01) |

(52) U.S. Cl.

CPC ..... *E21B 43/128* (2013.01); *E21B 23/14* (2013.01); *F04B 47/06* (2013.01)

(58) Field of Classification Search

CPC ..... F04B 47/06; E21B 43/128; E21B 23/14

USPC ..... 166/74

See application file for complete search history.

(56) References Cited

U.S. PATENT DOCUMENTS

| | | | | | |
|---|---|---|---|---|---|
| 750,205 | A * | 1/1904 | Layne | E21B 33/128 | 210/459 |
| 2,905,249 | A * | 9/1959 | Ownbey | E21B 43/08 | 175/402 |
| 3,710,862 | A * | 1/1973 | Young | E21B 43/14 | 166/131 |
| 4,757,878 | A * | 7/1988 | Iino | F16N 39/00 | 184/6.4 |
| 5,358,059 | A * | 10/1994 | Ho | E21B 47/00 | 175/45 |
| 6,120,261 | A * | 9/2000 | Al-Towailib | F04D 13/10 | 417/423.3 |
| 7,025,139 | B2 * | 4/2006 | Khomynets | F04F 5/10 | 166/259 |
| 7,640,979 | B2 * | 1/2010 | Watson | E21B 43/128 | 166/241.5 |

(Continued)

FOREIGN PATENT DOCUMENTS

| | | | |
|---|---|---|---|
| CN | 105178940 | A | 12/2015 |
| EP | 2464820 | A2 | 6/2012 |

*Primary Examiner* — Christopher S Bobish

(74) *Attorney, Agent, or Firm* — Vorys, Sater, Seymour and Pease LLP

(57) ABSTRACT

An Electric Submersible Pump (ESP) system may be installed in a wellbore for imparting an uphole thrust to wellbore fluids. Each component of the ESP system may have a hollow interior such that a longitudinal passageway is defined therethrough. The longitudinal passageway permits the passage of a variety of tools to perform logging operations, workover operations and/or other rig-less interventions without removing ESP system from the wellbore. A filter may be provided within the longitudinal passageway to prevent solids from entering the ESP system. The filter may rest on a profile provided within an intake of the ESP system such that the filter may be removed or replaced by rig-less slickline operations.

20 Claims, 6 Drawing Sheets

(56) References Cited

U.S. PATENT DOCUMENTS

| | | | | |
|---|---|---|---|---|
| 7,730,937 | B2 * | 6/2010 | Head | E21B 33/1275 166/66.4 |
| 10,883,506 | B2 | 1/2021 | Eslinger et al. | |
| 11,299,969 | B2 | 4/2022 | Xiao et al. | |
| 11,740,380 | B2 * | 8/2023 | Griffing | E21B 17/003 702/9 |
| 2004/0134653 | A1 * | 7/2004 | Khomynets | F04F 5/44 166/250.15 |
| 2008/0196880 | A1 * | 8/2008 | Head | E21B 33/1275 166/66.4 |
| 2009/0142207 | A1 | 6/2009 | Ring et al. | |

* cited by examiner

HOLLOW ELECTRICAL SUBMERSIBLE PUMP FOR UNLIMITED WELLBORE INTERVENTION

FIELD OF THE DISCLOSURE

The present disclosure relates to electrical submersible pumps (ESPs) used in hydrocarbon development operations, and more specifically, to systems for permitting tools to access portions of a wellbore downhole of an ESP, without a Y-tool installed in the wellbore.

BACKGROUND OF THE DISCLOSURE

In hydrocarbon developments, it is common practice to use ESP systems in a wellbore as a primary form of artificial lift, e.g., to assist in circulating hydrocarbons or other wellbore fluids to a surface location. However, with an ESP installed at an end of a production tubing, access to the reservoir downhole of the ESP is typically blocked. Reservoir access is often required to add additional perforations to provide fluid communication between the wellbore and the reservoir, to perform reservoir treatments such as acidizing or scale removal, or to run specialized logging tools on coiled tubing or wireline, such as for the identification of water or oil zones within the reservoir. Therefore, frequent reservoir access may be required while the ESP is in place.

In some cases, an ESP is used with an associated bypass system, which permits access to the wellbore downhole of the ESP without removal of the ESP. A typical bypass system includes a Y-tool having a production branch and a bypass branch, both branches in communication with the surface location by a production tubing string. The ESP may be installed in the production branch and the bypass branch may normally be sealed, e.g., with a blanking plug, during production of the wellbore fluids through the production branch. When an intervention is required through the bypass branch, a wireline operation may first be required to retrieve the blanking plug to permit an intervention tool to pass through the bypass branch. In wellbores where a Y-tool may be impractical, e.g., due to insufficient space for installing a Y-tool, a workover rig may be required to remove the entire ESP before an intervention may be completed. Removing the ESP is expensive and time consuming.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, an Electrical Submersible Pump (ESP) system includes a submersible pump defining a central bore extending longitudinally therethrough. The submersible pump is operable to pump in an uphole direction a wellbore fluid received in the central bore thereof. An intake is coupled to the submersible pump and defines a central bore extending longitudinally therethrough and aligned with the central bore of the submersible pump to define a longitudinal passageway through the ESP system through which an intervention tool may be passed. An intake filter is removably positioned within the central bore of the intake and is removable through the central bore of the submersible pump.

In another embodiment, a wellbore system for conducting intervention operations in a wellbore includes a production tubing string extending into the wellbore. A submersible pump is coupled to the production tubing string and defines defining a defining a central bore extending longitudinally therethrough. The submersible pump is operable to pump in an uphole direction a wellbore fluid received within the central bore thereof and discharge the wellbore fluid into the production tubing string. An intake is coupled to the submersible pump and defines a central bore extending longitudinally therethrough and aligned with the central bore of the submersible pump to define a longitudinal passageway through the submersible pump and the intake. An intake filter is removably positioned within the central bore of the intake and is removable through the central bore of the submersible pump and the production tubing string.

In another embodiment, a method for conducting an intervention operation in a wellbore includes (a) installing a hollow ESP system at a downhole location in the wellbore, (b) operating a submersible pump of the ESP system to pump a wellbore fluid in an uphole direction toward a surface location, (c) retrieving an intake filter from a longitudinal passageway defined through the ESP system, (d) conveying an intervention tool on a conveyance through the longitudinal passageway to a wellbore portion located downhole of the ESP system and (c) performing the intervention operation with the intervention tool disposed in the wellbore portion.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
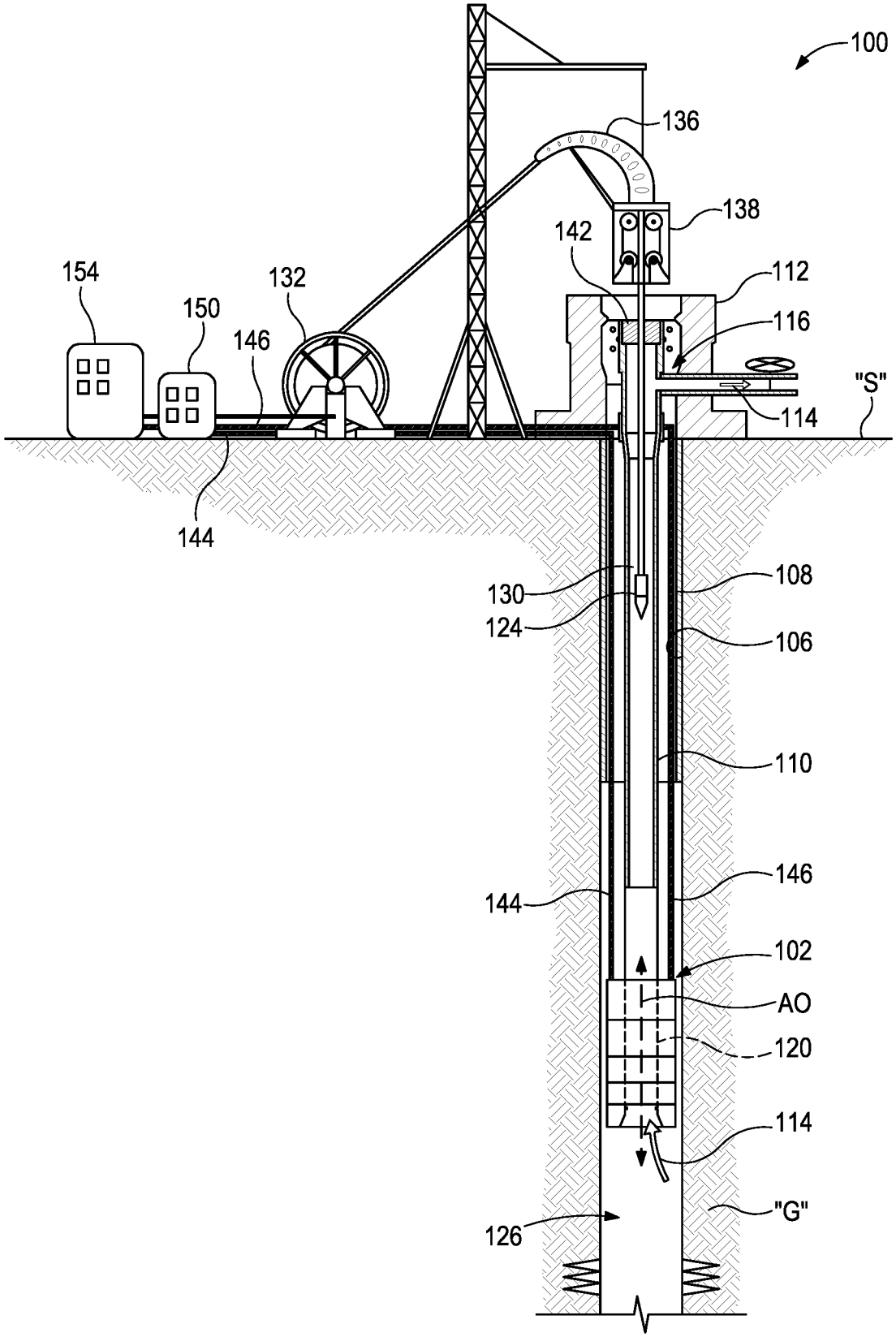
FIG. 1 is a cross-sectional view of a wellbore system including a hollow ESP system having an intervention tool, which may be passed through the hollow ESP system to a reservoir downhole of the ESP system in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to an Electric Submersible Pump (ESP) system installed in a wellbore. Each component of the ESP system may have a hollow interior such that a longitudinal passageway is defined therethrough. The longitudinal passageway permits the passage of a variety of tools to perform logging operations, workover operations and/or other rig-less interventions without removing ESP system from the wellbore. A filter may also be provided within the longitudinal passageway to prevent solids from entering the ESP system. The filter may rest on a profile provided within an intake of the ESP system such that the filter may be removed or replaced by rig-less slickline operations.

FIG. 1 is a schematic view of an example wellbore system 100 including a hollow ESP system 102 in accordance with one or more exemplary embodiments of the disclosure. The wellbore system 100 includes a wellbore 106 extending from a surface location "S" and traversing a geologic formation "G." In the illustrated example, the wellbore 106 is substantially vertical. In other embodiments, aspects of the disclosure may be practiced in a wide variety of vertical, directional, deviated, slanted and/or horizontal portions therein, and may extend along any trajectory through the geologic formation "G." As illustrated in FIG. 1, the wellbore 106 is partially lined with a casing string 108, however, in other embodiments, the wellbore 106 may be uncased without departing from the scope of the disclosure.

In the illustrated embodiment, the wellbore system 100 includes a production tubing string 110 extending into the wellbore 106 from a wellhead 112 arranged at the surface location "S." The production tubing string 110 may be constructed of a series of pipe sections coupled to one another in an end-to-end manner, or in some embodiments, the production tubing string 110 may be a continuous string of flexible tubing. The wellhead 112 generally provides a suspension point for the casing string 108 and the production tubing string 110 and also provides pressure control for the wellbore 106. The wellhead 112 may include a system valves and adaptors that distribute wellbore fluids 114 produced through the production tubing string 110 to an appropriate destination. For example, wellbore fluids 114 may be directed from the production string 110 through a tee 116 to a collection tank, pipeline or another downstream destination.

The hollow ESP system 102 is fluidly coupled to and otherwise arranged at a lower end of the production tubing string 110. The hollow ESP system 102 may deliver (draw) the wellbore fluids 114 from the wellbore 106 into the tubing string 110. More specifically, wellbore fluids 114 may enter the hollow ESP system 102 through a longitudinal passageway 120 defined through the ESP system 102, and as described in greater detail below. The longitudinal passageway 120 extends along a longitudinal axis A0 defined centrally through the hollow ESP system.

The longitudinal passageway 120 may permit passage of an intervention tool 124 though the ESP system 102 to access a reservoir or a portion 126 of the wellbore 106 located downhole of the ESP system 102 without removing the ESP system 102 from the wellbore 106. As described in greater detail below, in some embodiments, the ESP system 102 may continue to operate as the intervention tool 124 is passed (extended) through the longitudinal passageway 120 and while performing an intervention in the wellbore portion 126. The intervention tool 124 may be operable to conduct any number of workover or intervention operations such as production logging operations, perforating, acidizing or other wellbore treatments.

In some embodiments, as illustrated, the intervention tool 124 may be conveyed through the production tubing string 110 on a coiled tubing string 130. In other embodiments, the intervention tool 124 may be conveyed on slickline, wireline or another rig-less conveyance. The coiled tubing string 130 may be coiled at the surface location "S" on a spooling device 132 and may pass over a guide arch 136 which provides a bending radius for moving the coiled tubing string 130 to a vertical orientation for injection into the wellbore 106. From the guide arch 136, the coiled tubing string 130 passes into an injector 138, which grippingly engages the coiled tubing string 130 and pushes it through the wellhead 112 into the wellbore 106. The coiled tubing string 130 may pass through a seal 142 in the wellhead 112, which prevents wellbore fluids passing through the tee 116 from escaping while permitting the coiled tubing string 130 to be raised and lowered through the wellhead 112.

The hollow ESP system 102 may be communicatively coupled to the surface location "S" by a hydraulic cable 144 and an electrical cable 146. The hydraulic cable 144 may provide lubrication for the hollow ESP system 102, and the electrical cable 146 may transmit power and data signals between the hollow ESP system 102 and the surface location "S." At the surface location "S," the hydraulic and electrical cables 144, 146 are communicatively coupled to a hydraulic pump 150 and a controller 154. In other embodiments, the hydraulic pump 150 may be provided at a downhole location without departing from the scope of the disclosure. In some embodiments, the controller 154 may be a computer-based system that may include a processor, a memory storage device, and programs and instructions, accessible to the processor for executing the instructions utilizing the data stored in the memory storage device. In other embodiments, the controller 154 may include manual controls that may be manipulated by an operator to control any of the procedures and equipment described herein. The controller 154 may be employed to operate the hollow ESP system 102, the hydraulic pump 150, the intervention tool 124, the injector 138 and/or other components of the wellbore system 100. The controller 154 may provide instructions to the various components of the wellbore system 100 and receive data therefrom.

Figure 2A:
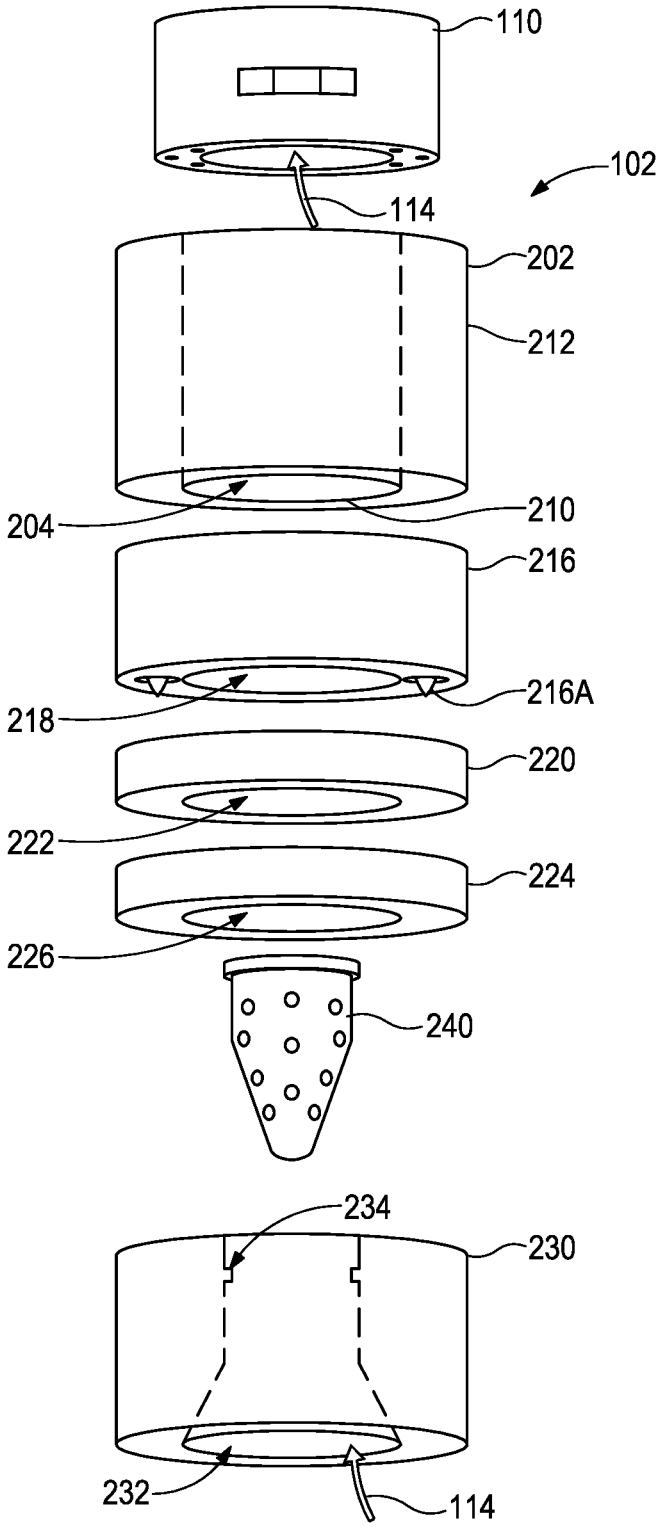
FIG. 2A is an enlarged exploded view of the hollow ESP system of FIG. 1 illustrating a submersible pump, a motor, a motor seal protector, an intake and a removable intake filter.

Referring now to FIG. 2A, a submersible pump 202 may be included at an uphole end of the hollow ESP system 102 and may include threads or another coupling to secure the hollow ESP system 102 to the distal end of the production tubing string 110 (FIG. 1). The submersible pump 202 may also include connectors (not shown) for coupling the hydraulic cable 144 (FIG. 1) and the electrical cable 146 (FIG. 1) to the hollow ESP system 102. A central bore 204 extends through the submersible pump 202 and fluidly communicates with the production tubing string 110.

The submersible pump 202 may have any suitable size or construction based on the characteristics (e.g., wellbore size, desired pumping rate, etc.) of the wellbore operation for which the hollow ESP system 102 is employed. The submersible pump 202 may be a multi-stage centrifugal pump that operates by transferring pressure to the wellbore fluids 114 to propel the wellbore fluids 114 to the surface location "S" at a desired pumping rate. The submersible pump 202 may operate to transfer pressure to the wellbore fluids 114 with one or more impellers 205 (FIG. 2B) and diffusers (not shown) arranged within the submersible pump 202, as generally recognized in the art. The impellers 205 may rotate with respect to the diffusers to impart an uphole thrust to the wellbore fluid 114. The submersible pump 202 may also include a rotating bearing system 210 to support the rotational motion of the impellers 205.

Figure 2B:
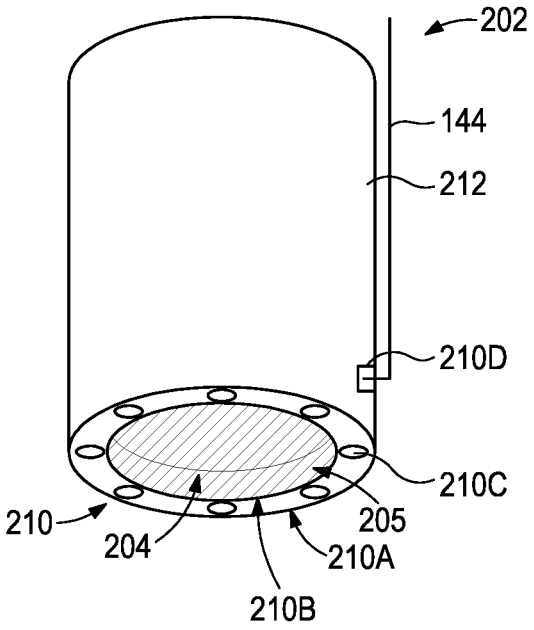
FIG. 2B is an enlarged perspective view of the submersible pump of the hollow ESP system.

As illustrated in FIG. 2B, the rotating bearing system 210 generally includes an outer ring 210A, an inner ring 210B and rotating elements 210C interposed between the inner and outer rings 210A, 210B. The inner ring 210B is rotatable with respect to the outer ring 210A about an axis extending through the central bore 204. The outer ring 210 may be held stationary with respect to an outer housing 212 of the pump 202 while the inner ring 210B may rotate with the impellers 205. The impellers 205 are exposed to the central bore 204 such that wellbore fluids 114 (FIG. 1) passing therethrough may be lifted by rotation of the impellers 205. A hydraulic inlet 210D extends through the outer ring 210A such that lubricant may be provided to the rotating elements 210C between the outer and inner rings 210A, 210B to support and lubricate rotation of the impellers 205.

Referring again to FIG. 2A, a motor 216 is operably coupled to the submersible pump 202 for driving the one or more impellers 205 (FIG. 2B) in the submersible pump 202. The motor 216 is a shaft-less motor operably coupled to the impellers 205, and operation of the motor 216 induces rotation of the impellers 205 without any physical shaft extending between the motor 216 and the pump 202. In other embodiments, a drive shaft (not shown) of the motor 216 may extend into the submersible pump 202 to transmit rotational motion generated by the motor 216 to the one or more impellers 205. The motor 216 may be constructed as a permanent magnet motor operably coupled to the electrical cable 146 (FIG. 1) to receive a constant voltage therefrom. The electrical cable 146 may be routed to other components of the ESP system 102 (see, e.g., FIG. 3) through passages 216A extending to longitudinal end surfaces of the motor 216. The motor 216 may also receive instructions from the controller 154 (FIG. 1) through the electrical cable 146. A central bore 218 is defined through the motor 216, which may be aligned with the central bore 204 of the submersible pump 202 when the motor 216 is coupled to the submersible pump 202.

A hollow motor seal protector 220 is coupled to a lower end of the motor 216, and defines a central bore 222 extending therethrough. The motor seal protector 220 includes seals therein, which protect the motor 216 from the ingress of wellbore fluids 114.

A hollow downhole sensor 224 may be coupled to a lower end of the motor seal protector 220, and may define a central bore 226 extending therethrough. The downhole sensor 224 may be operable to detect downhole conditions, such as an intake pressure for the submersible pump 202, downhole fluid temperatures and vibrational data. The downhole sensor 224 may be operably coupled to the electrical cable 146 (FIG. 1) such that the downhole sensor 224 may provide real-time data to the controller 154 (154). The central bores 222, 226 of the motor seal protector 220 and the downhole sensor 224 may be axially aligned with the central bores 204, 218 of the submersible pump 202 and the motor 216.

An intake 230 may be coupled to a lower end of the downhole sensor 224, and defines a central bore 232 extending therethrough. The central bore 232 is profiled to define a seat 234 therein. An intake filter 240 includes corresponding features or surfaces configured to engage the seat 234. Thus, the intake filter 240 may be received by or otherwise set down on the seat 234 with a slickline or other rig-less operation. In some embodiments, as illustrated, the intake filter 240 may be conically shaped, or may exhibit other geometries allowing for the intake filter 240 to extend into the central bore 232 of the intake 230. The intake filter 240 may be constructed of a screen material with micron scale holes defined therein, which permit wellbore fluids 114 to pass therethrough while prohibiting the passage of sand and other solids through the hollow ESP system 102.

Figure 2C:
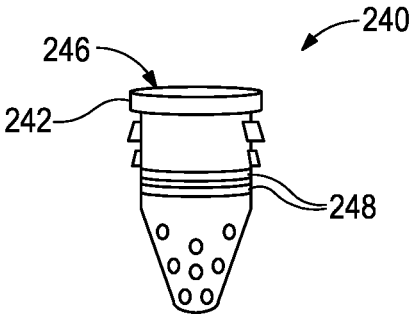
FIG. 2C is an enlarged perspective view of the removable intake filter of the hollow ESP system.

As illustrated in FIG. 2C, the intake filter 240 may define a tool neck portion 242 protruding radially outward at an uphole end 246 thereof. The tool neck portion 242 may be sized and otherwise configured to engage the seat 234 (FIG. 2A) of the intake 230 (FIG. 2A) to support the intake filter 240 within the intake 230. Moreover, in some embodiments, the intake filter 240 may include a plurality of annular seals 248 designed to prevent any fluid leaking between the intake filter 240 and the central bore 232 (FIG. 2A) of the intake 230. The annular seals 248 may comprise, for example, elastomeric O-ring seals, but could alternatively comprise other types of seals recognized in the art.

In some embodiments, one or more retractable keys 250 may be provided on the intake filter 240 to locate and engage corresponding slots (not shown) defined in the central bore 232 (FIG. 2A) of the intake 230 (FIG. 2A). The retractable keys 250 may secure the intake filter 240 within the intake 230 to ensure any uphole forces imparted on the intake filter 240 by the wellbore fluid 114 (FIG. 1) do not inadvertently dislodge the intake filter 240 from the intake 230.

Figure 3:
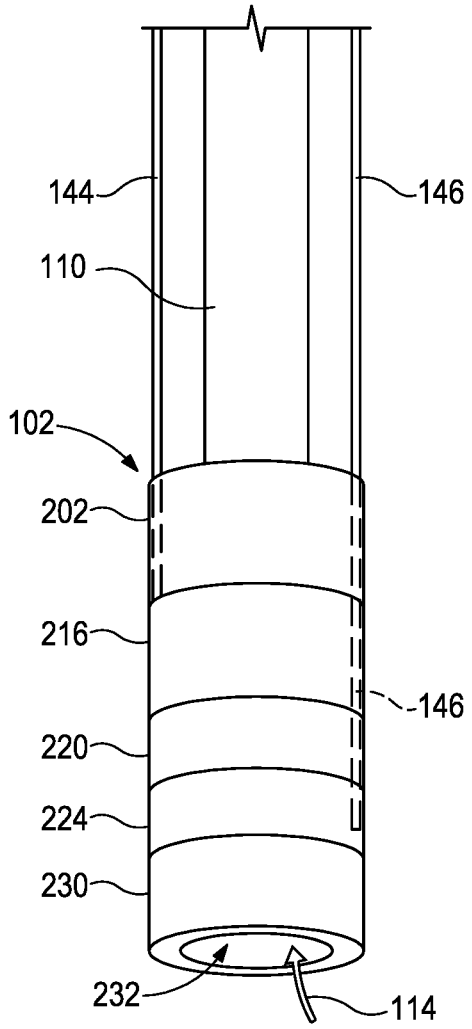
FIG. 3 is an enlarged view of the hollow ESP system assembled in an operational configuration with associated communication cables attached.

Referring now to FIG. 3, the hollow ESP system 102 is illustrated in an operational configuration coupled to the production tubing string 110. The motor 216 may receive a constant voltage and/or instructions to operate through electrical cable 146. The motor 216 drives the submersible pump 202 to draw wellbore fluids 114 into the central bore 232 of the intake 230. The submersible pump 202 may be lubricated during operation with a lubricant provided through the hydraulic cable 144. As the submersible pump 202 is operated, the downhole sensor 224 may provide data signals regarding downhole conditions to the controller 154 (FIG. 1) through the electrical cable 146. The wellbore fluid 114 drawn into the intake 230 may pass through the intake filter 240 (FIG. 2A) and continue through the hollow ESP system 102 to the production tubing 110, which may carry the wellbore fluids 114 to the surface location "S" (FIG. 1)

The production of wellbore fluid 114 to the surface may continue until an intervention is required. For example, the downhole sensor 220 may provide data signals or measurements indicative of a clogged intake filter 240 (FIG. 2A). The coiled tubing string 130, or alternatively slickline, wireline, or another rig-less conveyance, may be deployed to locate, couple to, and lift the intake filter 240 from the intake 230, following which the intake filter 240 may be returned to the surface location "S".

Figure 4:
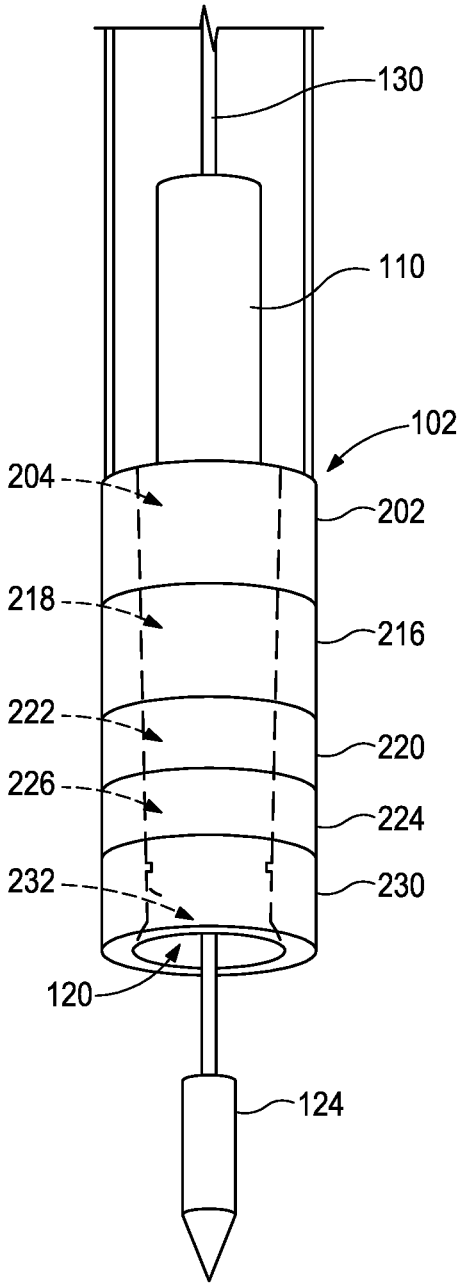
FIG. 4 is an enlarged view of the hollow ESP system with the intervention tool passed therethrough.

Referring to FIG. 4, once the intake filter 240 (FIG. 2A) is retrieved, the hollow ESP system 102 may be moved to an intervention configuration. The intervention tool 124 may be lowered through the production tubing string 110 on the coiled tubing string 130, or alternatively on slickline, wireline, or another rig-less conveyance. The intervention tool 124 may be passed through the axially aligned central bores 204, 218, 222, 226 and 232 of each of the submersible pump 202, the motor 216, the motor seal protector 220, the downhole sensor 224 and the intake 230, respectively, to access a reservoir or wellbore portion 126 below (downhole from) the hollow ESP system 102. The longitudinal passageway 120 is defined through the hollow ESP system 102 by the aligned central bores 204, 218, 222, 226 and 232 permitting passage of the intervention tool 124 therethrough. An intervention operation may then be conducted with the intervention tool 124 downhole from the hollow ESP system 102 and without requiring the costly and time-consuming removal of the hollow ESP system 102.

The intervention operation conducted with the intervention tool 124 may include, for example, wireline logging operations to evaluate casing or liner, hole conditions and wellbore surveillance. The intervention operation may also include coiled tubing operations such as clean out and remedial operations conducted with a milling intervention tool 124. Slickline operations such as fishing operations, temperature and pressure surveys and other similar operations. In some embodiments, the hollow ESP system 102 may continue to operate to produce wellbore fluids to the surface while the intervention tool 124 is deployed.

Figure 5:
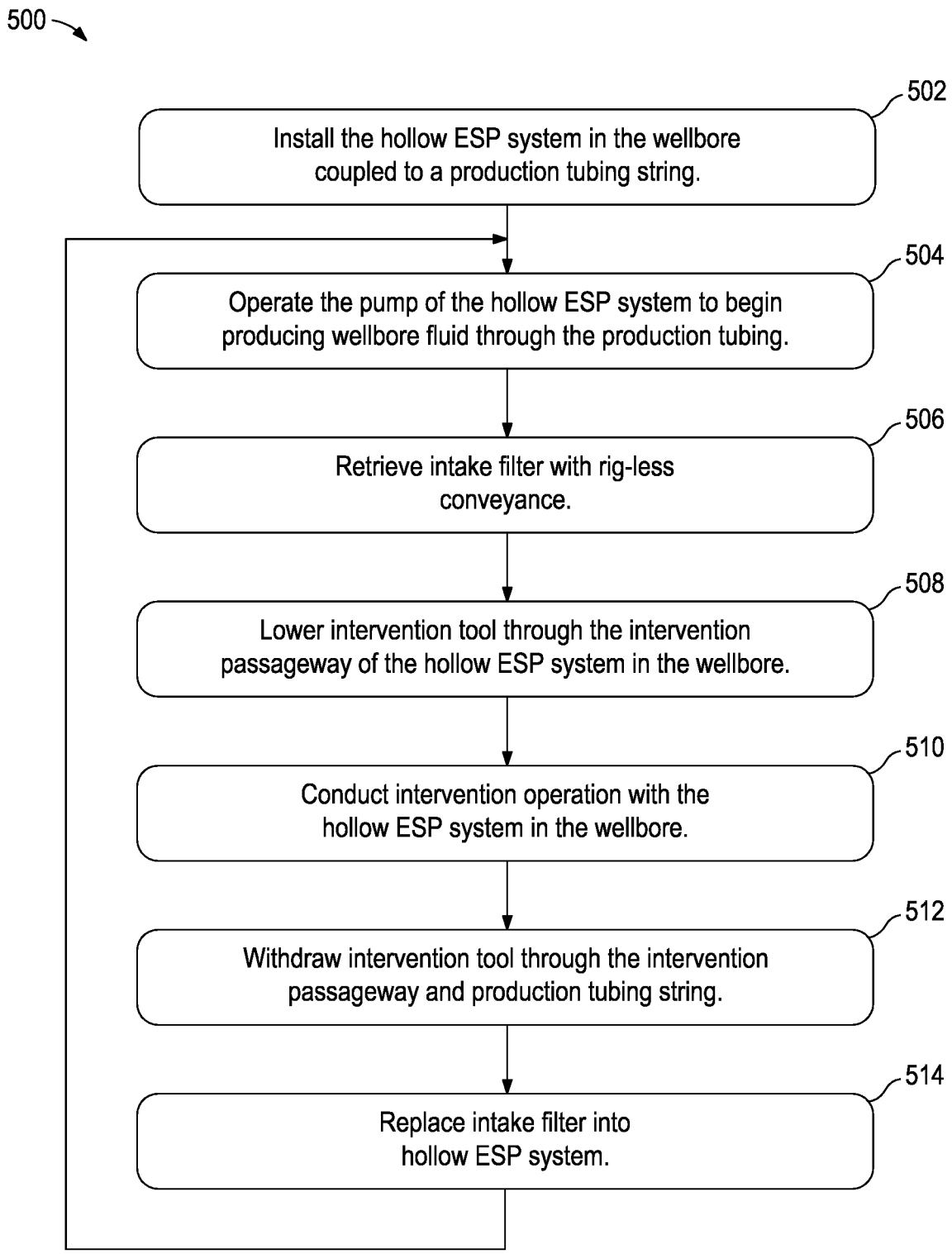
FIG. 5 is a flowchart illustrating a procedure for producing a wellbore fluid and conducting an intervention in a wellbore with the hollow ESP system of FIG. 1.

Referring now to FIG. 5, and with continued reference to FIGS. 1 through 4, an example method or procedure 500 is illustrated for conducting an intervention operation in the wellbore 106 with the hollow ESP system 102. Initially at step 502, the hollow ESP system 102 may be installed in the wellbore 106 in a production configuration wherein the intake filter 240 is seated within the intake 230. The hollow ESP system 102 may be lowered into position on the production tubing string 110, or the production tubing string 110 may be coupled to the hollow ESP system 102 after the hollow ESP system 102 has been installed at a desired location within the wellbore 106.

Next at step 504, the submersible pump 202 may be operated to produce wellbore fluids 114 to the surface location "S." The submersible pump 202 may draw wellbore fluids 114 through the intake 230 and intake filter 240, and impart energy to the wellbore fluids 114 to flow the wellbore fluids 202 to the surface location "S" through the production tubing string 110.

Once an intervention operation downhole from the hollow ESP system 102 is required, the procedure may advance to step 506 where the intake filter 240 is retrieved. A slickline, wireline, coiled tubing string 130, or other rig-less conveyance may be deployed through the production tubing string 110 and through the longitudinal passageway 120 to the intake filter 240. A fishing tool, hook or other connector at the end of the conveyance may locate and engage the intake filter 240 and lift the intake filter 240 out of the seat 234. The intake filter 240 may then be returned to the surface location "S" for inspection, cleaning and/or repair.

Next, the procedure 500 proceeds to step 508 where the intervention tool 124 is lowered into the wellbore on a slickline, wireline, coiled tubing string 130, or other rig-less conveyance. The intervention tool 124 is lowered through the production tubing 110 and the longitudinal passageway 120 to the wellbore portion 142 downhole of the hollow ESP system 102. The intervention operation may then be conducted at step 510. The intervention operation may include logging operations, clean out operations, fishing operations and any other rig-less operation that may be required. Since it is not necessary to remove the hollow ESP system 102 from the wellbore to conduct the intervention operation, the time and expense of erecting and operating a workover rig, for example, may be avoided.

At step 512, the intervention tool 124 may be removed from the wellbore 106 once the intervention operation is complete. The intervention tool 124 may be raised through the longitudinal passageway 120 and the production tubing string 110 on the conveyance and removed from the wellbore 106. Then at step 514, the intake filter 124 may be replaced and reseated on a rig-less conveyance. The procedure 500 may then return to step 504 to continue producing wellbore fluids to the surface.

Figure 6:
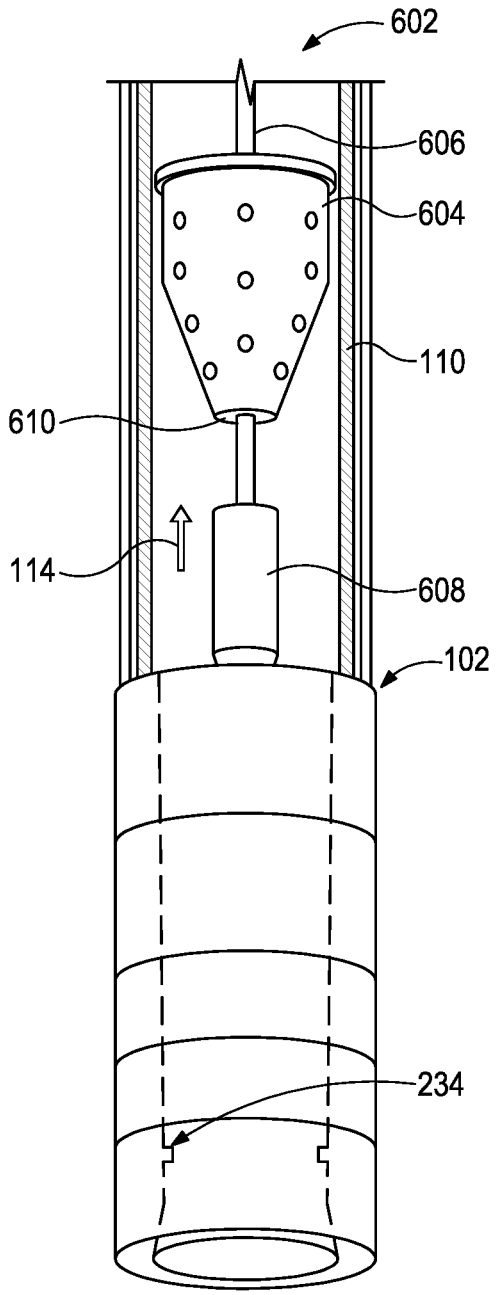
FIG. 6 is a schematic view of an alternate embodiment of an intervention tool passing through the hollow ESP system and carrying a filter member.

Referring now to FIG. 6, an alternate embodiment of an intervention tool 602 is illustrated, which may facilitate continued operation of the submersible pump 202 during an intervention operation. The intervention tool 602 includes a filter member 604 supported on a rig-less conveyance 606 and a tool head 608 at a lower end of the conveyance 606. The filter member 604 includes a dynamic seal 610 thereon for engaging the conveyance 606. In operation, the intervention tool 602 may be lowered through production tubing string 110 on the conveyance 606 to the hollow ESP system 102. The intervention tool 602 may be lowered through the longitudinal passageway 120 until the filter member 604 engages the seat 234. The submersible pump 202 may then be operated to flow wellbore fluids 114 through the filter member 604. The tool head 608 may be further lowered on the conveyance 606 to the downhole wellbore portion 126 where the intervention operation is to be conducted. The dynamic seal 610 allows continued downhole movement of the conveyance 606 once the filter member 604 is seated. In this manner, the intervention operation may be conducted while wellbore fluids 114 are being pumped to the surface location "S," and while sand and other solids are filtered from the wellbore fluids by the filter member 604.

Embodiments disclosed herein include:

A. An Electrical Submersible Pump (ESP) system is disclosed and includes a submersible pump defining a central bore extending longitudinally therethrough. The submersible pump is operable to pump in an uphole direction a wellbore fluid received in the central bore thereof. The ESP system may further include an intake coupled to the submersible pump and defining a central bore extending longitudinally therethrough and aligned with the central bore of the submersible pump to define a longitudinal passageway through the ESP system through which an intervention tool may be passed. The ESP system may further include an intake filter removably positioned within the central bore of the intake, the intake filter removable through the central bore of the submersible pump.

B. A wellbore system for conducting intervention operations in a wellbore is disclosed and includes a production tubing string extending into the wellbore. A submersible pump is coupled to the production tubing string, the submersible pump defining a defining a central bore extending longitudinally therethrough. The submersible pump is operable to pump in an uphole direction a wellbore fluid received within the central bore thereof and discharge the wellbore fluid into the production tubing string. The wellbore system may further include an intake coupled to the submersible pump and defining a central bore extending longitudinally therethrough and aligned with the central bore of the submersible pump to define a longitudinal passageway through the submersible pump and the intake. The wellbore system may further include an intake filter removably positioned within the central bore of the intake, and the intake filter may be removable through the central bore of the submersible pump and the production tubing string.

C. A method for conducting an intervention operation in a wellbore is disclosed and includes installing a hollow ESP system at a downhole location in the wellbore, operating a submersible pump of the ESP system to pump a wellbore fluid in an uphole direction toward a surface location, retrieving an intake filter from a longitudinal passageway defined through the ESP system, conveying an intervention tool on a conveyance through the longitudinal passageway to a wellbore portion located downhole of the ESP system and performing the intervention operation with the intervention tool disposed in the wellbore portion.

Each of embodiments A, B, and C may have one or more of the following additional elements in any combination: Element 1: wherein the central bore of the intake defines a seat and the intake filter rests on the seat when positioned within the central bore of the intake. Element 2: wherein the intake filter includes a radially extending tool neck portion engageable with the seat. Element 3: further comprising a hydraulic cable coupled to the submersible pump and operable to deliver lubricant to the submersible pump. Element 4: further comprising a motor, motor seal protector and downhole sensor, wherein each of the motor, the motor seal protector, and the downhole sensor axially interpose the submersible pump and the intake and wherein each includes a central bore extending therethrough and aligned with the central bores of the submersible pump and the intake. Element 5: further comprising an electrical cable coupled to the motor and operable to provide electrical power thereto, the electrical cable being further coupled to the downhole sensor and operable to transmit signal data therefrom. Element 6: wherein the motor is a shaftless permanent magnet motor operably coupled to an impeller within the submersible pump.

Element 7: wherein the central bore of the intake defines a seat and the intake filter rests on the seat such that the intake filter may be lifted through the submersible pump by a conveyance extending through the production tubing string. Element 8: further comprising an intervention tool passable through the longitudinal passageway to a wellbore portion located downhole of the submersible pump and the intake. Element 9: wherein the intervention tool is a production logging tool operable to evaluate conditions within the wellbore portion. Element 10 further comprising a hydraulic cable operably coupled between the submersible pump and a hydraulic pump arranged at a well surface location, the hydraulic pump operable to deliver a lubricant to a rotating bearing system within the submersible pump through the hydraulic cable. Element 11: further comprising a motor operably coupled to the submersible pump, a motor seal protector and a downhole sensor, wherein each of the motor, the motor seal protector, and the downhole sensor interpose the submersible pump and the intake, and wherein each of the motor, the motor seal protector and the downhole sensor includes a central bore extending therethrough and aligned with the central bores of the submersible pump and the intake. Element 12: further comprising an electrical cable operably coupled between the motor and a controller arranged at a well surface location, the controller being selectively operable to provide electrical power to the motor to drive the pump. Element 13: wherein the electrical cable is further coupled to the downhole sensor, the downhole sensor being operable to provide data through the electrical cable, and the data being indicative of a downhole condition in the wellbore.

Element 14: wherein retrieving the intake filter includes lifting the intake filter from a seat defined in the longitudinal passageway with the conveyance extending to the ESP system through a production tubing string in the wellbore. Element 15: wherein operating the submersible pump includes providing a lubricant to the submersible pump through a hydraulic cable extending between a surface location and the ESP system installed in the wellbore. Element 16: wherein performing the intervention operation includes conducting a logging operation to evaluate conditions within the wellbore portion below the ESP system. Element 17: wherein performing the intervention operation is performed concurrently while operating the submersible pump.

By way of non-limiting example, exemplary combinations applicable to A, B, and C include: Element 1 with Element 2; Element 4 with Element 5; Element 5 with Element 6; Element 8 with Element 9; Element 11 with Element 12; and Element 12 with Element 13.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The invention claimed is:

1. An Electrical Submersible Pump (ESP) system, comprising:

a submersible pump defining a central bore extending longitudinally therethrough, the submersible pump being operable to pump in an uphole direction a wellbore fluid received in the central bore thereof;

an intake coupled to the submersible pump and defining a central bore extending longitudinally therethrough and aligned with the central bore of the submersible pump to define a longitudinal passageway through the ESP system through which an intervention tool may be passed;

an intake filter removably positioned within the central bore of the intake and removable through the central bore of the submersible pump; and a downhole sensor axially interposing the submersible pump and the intake, wherein the downhole sensor includes a central bore extending therethrough that is aligned with the central bores of the submersible pump and the intake.

2. The ESP system of claim 1, wherein the central bore of the intake defines a seat and the intake filter rests on the seat when positioned within the central bore of the intake.

3. The ESP system of claim 2, wherein the intake filter includes a radially extending tool neck portion engageable with the seat.

4. The ESP system of claim 1, further comprising a hydraulic cable coupled to the submersible pump and operable to deliver lubricant to the submersible pump.

5. The ESP system of claim 1, further comprising:

a motor;

a motor seal protector; and wherein each of the motor and the motor seal protector axially interpose the submersible pump and the intake, and wherein each includes a central bore extending therethrough and aligned with the central bores of the submersible pump and the intake.

6. The ESP system of claim 5, further comprising an electrical cable coupled to the motor and operable to provide electrical power thereto, the electrical cable being further coupled to the downhole sensor and operable to transmit signal data therefrom.

7. The ESP system of claim 6, wherein the motor is a shaftless permanent magnet motor operably coupled to an impeller within the submersible pump.

8. A wellbore system for conducting intervention operations in a wellbore, the system comprising:

a production tubing string extending into the wellbore;

a submersible pump coupled to the production tubing string and defining a central bore extending longitudinally therethrough, the submersible pump being operable to pump in an uphole direction a wellbore fluid received within the central bore thereof and discharge the wellbore fluid into the production tubing string;

an intake coupled to the submersible pump and defining a central bore extending longitudinally therethrough and aligned with the central bore of the submersible pump to define a longitudinal passageway through the submersible pump and the intake;

an intake filter removably positioned within the central bore of the intake and removable through the central bore of the submersible pump and the production tubing string; and a downhole sensor axially interposing the submersible pump and the intake, wherein the downhole sensor includes a central bore extending therethrough that is aligned with the central bores of the submersible pump and the intake.

9. The wellbore system of claim 8, wherein the central bore of the intake defines a seat and the intake filter rests on the seat such that the intake filter may be lifted through the submersible pump by a conveyance extending through the production tubing string.

10. The wellbore system of claim 8, further comprising an intervention tool passable through the longitudinal passageway to a wellbore portion located downhole of the submersible pump and the intake.

11. The wellbore system of claim 10, wherein the intervention tool is a production logging tool operable to evaluate conditions within the wellbore portion.

12. The wellbore system of claim 8, further comprising a hydraulic cable operably coupled between the submersible pump and a hydraulic pump arranged at a well surface location, the hydraulic pump operable to deliver a lubricant to a rotating bearing system within the submersible pump through the hydraulic cable.

13. The wellbore system of claim 8, further comprising:

a motor operably coupled to the submersible pump; and a motor seal protector;

wherein each of the motor and the motor seal protector interpose the submersible pump and the intake, and wherein each of the motor and the motor seal protector includes a central bore extending therethrough and aligned with the central bores of the submersible pump and the intake.

14. The wellbore system of claim 13, further comprising an electrical cable operably coupled between the motor and a controller arranged at a well surface location, the controller being selectively operable to provide electrical power to the motor to drive the pump.

15. The wellbore system of claim 14, wherein the electrical cable is further coupled to the downhole sensor, the downhole sensor being operable to provide data through the electrical cable, and the data being indicative of a downhole condition in the wellbore.

16. A method for conducting an intervention operation in a wellbore, the method comprising:

installing a hollow ESP system at a downhole location in the wellbore;

operating a submersible pump of the ESP system to pump a wellbore fluid in an uphole direction and toward a surface location;

detecting down hole conditions with a sensor axially interposing the submersible pump and an intake of the ESP system, wherein the downhole sensor includes a central bore extending therethrough that is aligned with central bores of the submersible pump and the intake;

retrieving an intake filter from the intake through a longitudinal passageway defined through the ESP system in response to detecting the downhole conditions, wherein the longitudinal passageway includes the central bores of the motor and the sensor;

conveying an intervention tool on a conveyance through the longitudinal passageway to a wellbore portion located downhole of the ESP system; and performing the intervention operation with the intervention tool disposed in the wellbore portion.

17. The method of claim 16, wherein retrieving the intake filter includes lifting the intake filter from a seat defined in the longitudinal passageway with the conveyance extending to the ESP system through a production tubing string in the wellbore.

18. The method of claim 16, wherein operating the submersible pump includes providing a lubricant to the submersible pump through a hydraulic cable extending between a surface location and the ESP system installed in the wellbore.

19. The method of claim 16, wherein performing the intervention operation includes conducting a logging operation to evaluate conditions within the wellbore portion below the ESP system.

20. The method of claim 16, wherein performing the intervention operation is performed concurrently while operating the submersible pump.

* * * * *